US006912804B2

(12) United States Patent
Charles

(10) Patent No.: US 6,912,804 B2
(45) Date of Patent: Jul. 5, 2005

(54) LOADER-TYPE HEAVY-CONSTRUCTION MACHINE

(75) Inventor: Georges Charles, Limas (FR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 102 days.

(21) Appl. No.: 10/659,643

(22) Filed: Sep. 10, 2003

(65) Prior Publication Data

US 2004/0060711 A1 Apr. 1, 2004

Related U.S. Application Data

(63) Continuation of application No. PCT/FR02/00976, filed on Mar. 20, 2002.

(30) Foreign Application Priority Data

Mar. 22, 2001 (FR) ..... 01 03858

(51) Int. Cl.[7] ..... G05D 1/02; B66F 9/00
(52) U.S. Cl. ..... 37/348; 414/701; 414/708
(58) Field of Search ..... 37/348, 382, 409, 37/410; 414/700, 701, 708, 815

(56) References Cited

U.S. PATENT DOCUMENTS

| | | | | | |
|---|---|---|---|---|---|
| 3,141,562 | A | * | 7/1964 | McAdams | 414/699 |
| 3,521,781 | A | | 7/1970 | Holsinger et al. | 214/764 |
| 3,522,897 | A | * | 8/1970 | Freedy | 414/701 |
| 3,642,159 | A | * | 2/1972 | Askins | 414/701 |
| 3,695,474 | A | | 10/1972 | Blakely | 214/771 |
| 3,856,163 | A | | 12/1974 | Seaberg | 214/152 |
| 3,872,990 | A | * | 3/1975 | York | 414/700 |
| 3,896,951 | A | | 7/1975 | Seaberg et al. | 214/152 |
| 3,929,245 | A | | 12/1975 | Inoue | 214/764 |
| 4,109,812 | A | * | 8/1978 | Adams et al. | 414/699 |
| 4,375,344 | A | | 3/1983 | Baum et al. | 414/708 |
| 4,810,161 | A | * | 3/1989 | Dady, Sr. | 414/700 |
| 5,383,390 | A | * | 1/1995 | Lukich | 91/361 |
| 5,501,570 | A | | 3/1996 | Mozingo | 414/700 |
| 6,757,994 | B1 | * | 7/2004 | Hendron | 37/348 |

FOREIGN PATENT DOCUMENTS

| | | | |
|---|---|---|---|
| DE | 28 53 775 | 7/1980 | B65G/65/04 |
| DE | 38 22 145 A1 | 1/1990 | E02F/3/43 |

* cited by examiner

*Primary Examiner*—Victor Batson
(74) *Attorney, Agent, or Firm*—Heslin Rothenberg Farley & Mesiti P.C.

(57) ABSTRACT

A loader-type heavy construction machine has a chassis and work equipment. The work equipment includes two parallel arms articulated relative to the frame, a bucket articulated relative to the arms, a set of link rods forming, with a portion of the bucket and of the arms, a deformable parallelogram, and a bucket actuator capable of being controlled to cause deformation of the deformable parallelogram so as to orient the bucket with respect to the arms. A cam is moved by a connecting bar connected at one end to the deformable parallelogram so that the position of the cam is dependent on the orientation of the bucket with respect to the chassis. The cam interfaces with an hydraulic circuit to ensure that the bucket is maintained in a position preventing it from accidentally tipping over backwards, regardless of commands exerted on an hydraulic manipulator by a driver of the machine.

2 Claims, 3 Drawing Sheets

LOADER-TYPE HEAVY-CONSTRUCTION MACHINE

CROSS-REFERENCE TO RELATED APPLICATIONS

This application is a continuation of international application PCT/FR 02/00976 filed Mar. 20, 2002 and published, in French, as WO 02/081828 on Oct. 17, 2002, and claims priority from Application No. 01.03858 filed Mar. 22, 2001 in France.

TECHNICAL FIELD

The invention relates to the field of construction engineering machines, more particularly machines of the loader type. It is aimed more specifically at a device that automatically corrects the orientation of the bucket during the various loading operations.

PRIOR ART

In general, a construction engineering machine that allows material laid out on the ground to be picked up and tipped out into a skip or a truck, or vice versa, is known as "loader". A loader therefore comprises, in a known way, a chassis and special work equipment. This work equipment generally includes two parallel arms articulated with respect to the chassis. These arms can be raised under the action of actuators generally known as "arm actuators".

The ends of the arms take a bucket which is itself articulated with respect to the arms. To allow the bucket to move with respect to the arms, the work equipment also comprises a set of link rods which, with a portion of the bucket and of the arms, form a deformable parallelogram. In general, one of these link rods is articulated with respect to the bucket while the other is articulated with respect to the arms, these two link rods being articulated to one another via their ends. The work equipment also comprises a bucket actuator which is controlled in order to cause deformation of the deformable parallelogram, allowing the bucket to be orientated with respect to the arms.

The driver can separately control the arm actuator and the bucket actuator. Thus, by acting on the arm actuator, he raises the arms, thereby lifting the bucket.

By acting on the bucket actuator, he alters the orientation of the bucket with respect to the arms, and therefore with respect to the chassis. Thus, once the bucket has been filled with materials, it is pivoted backward so that its opening faces upward. Conversely, when the bucket has reached the desired height, it is pivoted forward, so as to be emptied out into the skip as intended.

As the bucket is arranged at the end of the main arms, when these arms are raised, the orientation of the bucket varies with respect to the ground. In order thus to prevent the bucket from tipping over backward, it is necessary for the orientation of the bucket with respect to the arms to be altered by deformation of the deformable parallelogram. During the upward movement of the arms, the bucket actuator is therefore actuated to keep the bucket opening in a constant inclination, so as to prevent this bucket from tipping over backward when such tipping is not wanted.

This correction of the inclination of the bucket can be performed by the driver acting appropriately on the bucket actuator via the manipulator.

This correction of the inclination of the bucket can also take place automatically, via a correction device. Such a device comprises, in a known way, a connecting rod which is articulated at one of its ends to one of the link rods of the deformable parallelogram. At its other end, the connecting rod acts on a hydraulic directional control valve spool supplying the bucket actuator. This connecting rod actuates the spool of the directional control valve which acts on the bucket actuator according to the position of the connecting rod, that is to say according to the orientation of the bucket with respect to the arms.

It will be appreciated that this solution has certain disadvantages, particularly the fact that it acts directly on the spool of the directional control valve, which means that it has a reaction on the control manipulator on which the driver acts.

In other words, this automatic correction generates resistance in the movement of the manipulator and this is felt by the driver and may prove disagreeable.

Furthermore, such a correction by mechanical action on the hydraulic directional control valve is incompatible with the use of a hydraulic manipulator which acts on the directional control valve by applying a pressure according to the position of the manipulator.

Solutions which consist in equipping the arms and the deformable parallelogram with additional sets of links each connected to the chassis and to the link rods, so as to bring about deformation of the deformable parallelogram and therefore correction of the orientation of the bucket according to the movement of the arms, have already been proposed. Such a solution is mechanically complicated and it is particularly difficult to set up.

A first problem that the invention sets out to solve is that of allowing the inclination of the bucket to be corrected, without this correction being felt at the manipulator. Another problem that the invention sets out to solve is that of allowing automatic correction of the inclination of the bucket which is compatible with the use of a hydraulic manipulator, which is more ergonomic than a mechanical manipulator.

SUMMARY OF THE INVENTION

The invention therefore relates to a construction engineering machine of the "loader" type. Such a loader comprises a chassis and work equipment. The work equipment includes:

- two parallel arms articulated with respect to the chassis;
- a bucket articulated with respect to the arms;
- a set of link rods forming, with a portion of the bucket and of the arms, a deformable parallelogram;
- a bucket actuator designed to be controlled in order to cause deformation of the deformable parallelogram so as to orientate the bucket with respect to the arms.

According to the invention, this machine is characterized in that it also comprises:

- a hydraulic control circuit allowing the bucket actuator to be supplied via a directional control valve controlled by a hydraulic manipulator delivering a control pressure;
- a cam mechanism moved by a connecting bar connected by one end to the deformable parallelogram so that the position of the cam is dependent on the orientation of the bucket with respect to the chassis;
- a hydraulic device allowing the generation of an additional control pressure according to the position of the cam;
- a circuit selector able to transmit to the directional control valve the higher of the control pressure delivered by the manipulator and the additional control pressure, so that the orientation of the bucket is kept in a position that prevents its unwanted tipping backward, regardless of the commands exerted on the manipulator by the driver.

In other words, the connecting bar mechanically relays the information about the angle between the arm and the link rod of the deformable parallelogram. This connecting bar causes the rotation of a cam which acts on a hydraulic valve. This valve delivers a pressure which, if higher than the pressure delivered by the manipulator, takes over from the latter so that the directional control valve supplies the bucket actuator in a corrected fashion.

This is then a correction which produces no mechanical effect in the user's manipulator, thus improving the comfort with which operations are controlled. In practice, the circuit selector is arranged on the fraction of the hydraulic control circuit concerned with the tipping-out of the bucket. Indeed, it is of overriding importance that the bucket should not tip over backward when lifted during the loading operation. Thus, the correcting device generates an additional control pressure which is compared with the pressure from the hydraulic manipulator when the latter is commanded to raise the arms.

BRIEF DESCRIPTION OF THE DRAWINGS

The way in which the invention is achieved and the advantages that ensue therefrom will become clearly apparent from the description of the embodiment which follows, in support of the attached figures in which.

EMBODIMENT OF THE INVENTION

Figure 1:
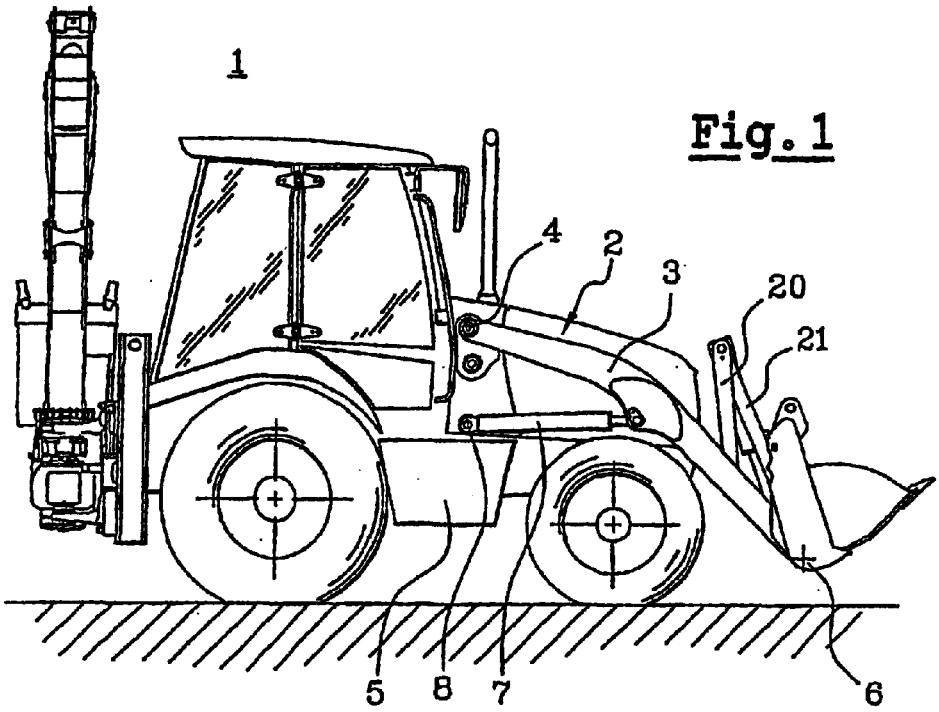
FIG. 1 is an overall side view of a machine of the loader/shovel type.

As already stated, the invention relates to a construction engineering machine having a "loader" and, for example, a "loader/shovel" function as illustrated in FIG. 1. In its front part, this machine (1) comprises work equipment (2) allowing it to act as a loader. This work equipment (2) mainly comprises two arms (3) situated one on each side of the machine. Via their rear ends (4) these arms (3) are articulated to the chassis (5). These arms (3) have a slightly curved shape so that their front ends (6) are roughly at ground level when the arms (3) are in the lowermost position. These arms (3) can be moved under the action of two arm actuators (7) also situated one on each side of the chassis (5). These actuators (7) are articulated by one end (8) to the chassis and by their opposite end (9) to the main arms (3) roughly at the middle (10) thereof.

At their front ends (6), the main arms (3) take a bucket (15). This bucket (15) is articulated with respect to the arms (3) so that it can be inclined at different angles. In this way, the opening (16) of the bucket can be orientated either forward, when materials (17) need to be got into it, or backward when the bucket (15) is full and being moved around.

In the form illustrated, the work equipment (2) also comprises two link rods (20, 21) which, with the end part of the arms (3) and part of the bucket (15), form a deformable parallelogram. More specifically, the work equipment (2) comprises a rear first link rod (20) which is articulated by its bottom end (22) to the main arm (3). The equipment also comprises a front link rod (21) articulated by its bottom end (23) to the bucket, at a point higher up than the point (13) at which the bucket (15) is articulated with respect to the arms (3). The two, front (21) and rear (20), link rods are articulated to one another at their upper ends (25). Thus, as the orientation of the bucket (15) varies with respect to the arms (3), the deformable parallelogram including the link rods (20, 21) deforms. This deformation of the deformable parallelogram is brought about by the action of a bucket actuator (27). This bucket actuator (27) has a rod (28) articulated to the bucket (15) more or less between the point of articulation (23) of the front link rod (21) and the point of articulation (13) of the bucket with respect to the arms. The chamber (29) of the bucket actuator (27) for its part is connected to the point of articulation (25) common to the two, front (21) and rear (20), link rods. Thus, when force is exerted by the bucket actuator (27), the latter causes the common point of articulation (25) of the link rods to move closer to or further away from the bucket (15) and therefore causes deformation of the deformable parallelogram and hence varies the inclination of the bucket (15) with respect to the arms (3).

As already mentioned, the invention allows this bucket actuator (27) to be controlled in such a way as to automatically correct the inclination of the bucket (15) regardless of the position of the arms (3). Thus, to perform this function, the work equipment comprises a connecting bar (30) running along the main arm (3) roughly from the region in which the rear link rod (20) is articulated and roughly as far as the point of articulation (8) of the arm (3) with respect to the chassis (5). The front end (31) of this connecting bar (30) is articulated to the rear link rod (20) at the point of articulation (32).

Figure 3:
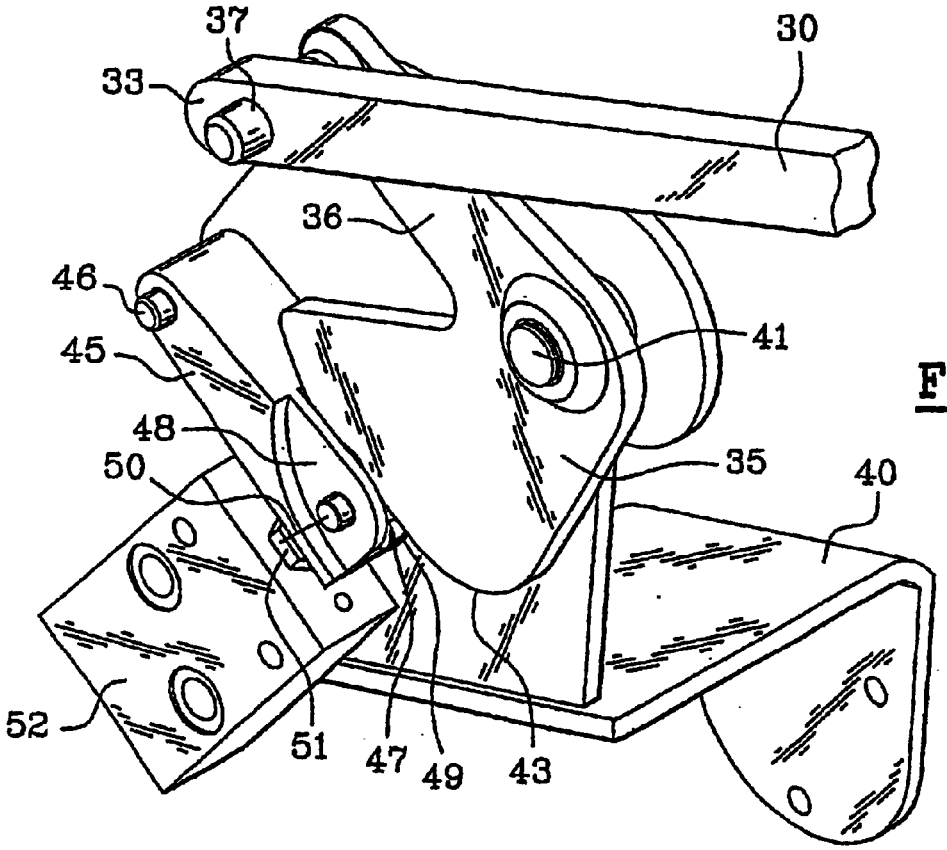
FIG. 3 is an outline perspective view of the cam mechanism according to the invention.

The other end (33) of the connecting bar (30) is itself articulated roughly at the point of articulation (8) of the arm (3) with respect to the chassis (5). More specifically, this end of this connecting bar is articulated to a cam as illustrated in FIG. 3. Thus, the end (33) of the connecting bar is articulated with respect to the cam (35) at the branch (36) comprising a through opening (37). This cam (35) is mounted with the ability to pivot about a mount (40) itself secured to the chassis (5). Rotation of the cam (35) with respect to the mount (40) is about the pin (41) passing through the opening (41) formed for this purpose in the cam (35).

The cam (35) has a curved surface (43) each point of which is at a different distance from the axis of rotation (41) of the cam. This curved surface (35) comes into contact with a lever (45) itself articulated with respect to the mount (40) about an axis of rotation (46). This lever has a groove (47) of which the walls (48, 49) sit on each side of the cam (35) to prevent the latter from moving away. This groove (47) has, passing through it, a rod (50) connecting the two walls (48, 49). The curved surface (43) of the cam (35) comes into contact with this rod (50).

As it moves, the lever (45) comes into contact with the moving parts (51) of a hydraulic remote control (52). Thus, as it moves, the cam (35) pushes on the lever (45), while return means (not depicted) situated inside the hydraulic remote control press this lever (45) against the cam (35). This hydraulic remote control (52) is therefore operated according to the position of the lever (45), that is to say of the cam (35), and therefore of the movement of the connecting bar (30), itself reflecting the inclination of the bucket (15).

Figure 4:
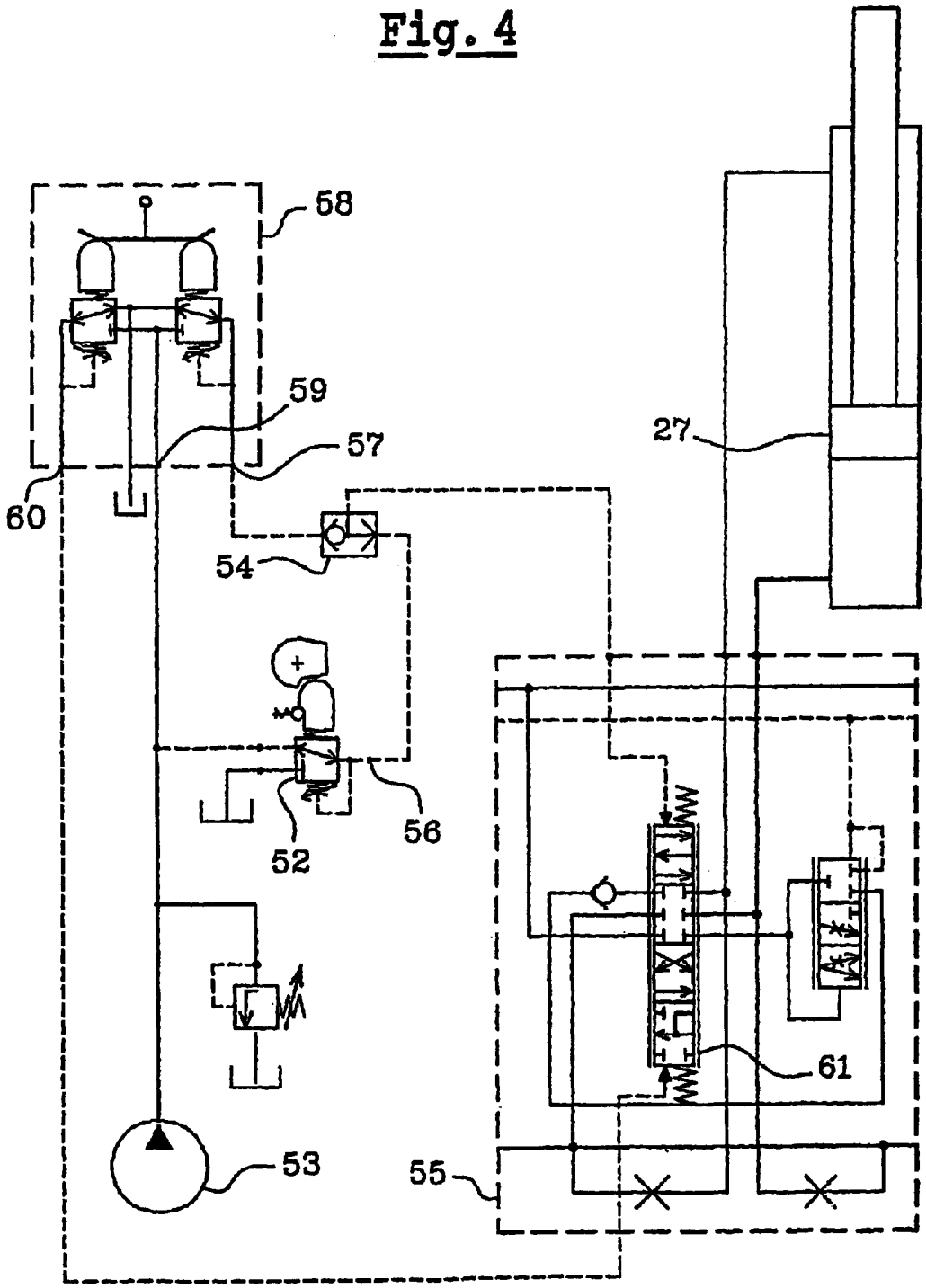
FIG. 4 is a diagram of the hydraulic control circuit controlling the bucket actuator.

This hydraulic remote control (52) is inserted in the hydraulic control circuit illustrated in FIG. 4. More specifically, this hydraulic remote control (52) is connected upstream to the main pressure source embodied by the pump (53). Downstream, this hydraulic remote control (52) is connected to a circuit selector (54) which provides selective connection between, on the one hand, the directional control valve (55) for controlling the bucket actuator (27) and, on the other hand, either the outlet (56) of the hydraulic remote control (52) or the outlet (57) of the control manipulator (58). More specifically, this control manipulator (58) has a pressure supply (59) from the main pump (53) and two outlet ports (57, 60) each corresponding to one orientation of the bucket. The first outlet (60) corresponds to the command to raise the bucket, while the second outlet (57) corresponds to the command to tip the bucket out.

Thus, the circuit selector (54) transmits to the directional control valve (55) the pressure which is the highest of the control pressure from the manipulator (58) and the pressure delivered by the hydraulic remote control (52). It is this pressure which then acts on the spool (61) of the directional control valve to cause the bucket actuator (27) to move.

Figure 5:
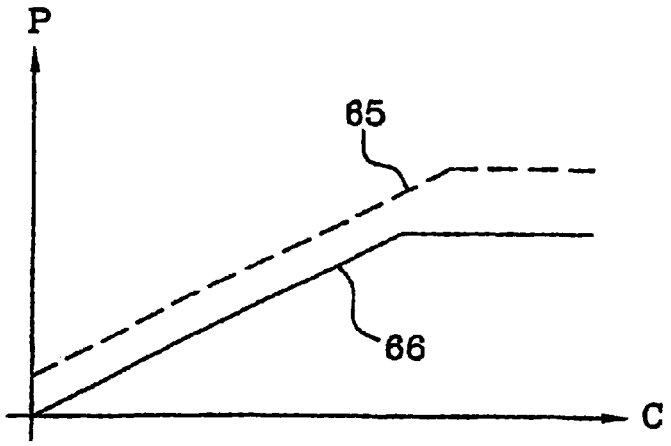
FIG. 5 is a diagram showing the variations in control pressure from the manipulator and the additional control pressure, as a function of the movement of the connecting bar.

Thus, when the pressure delivered by the manipulator (58) is higher than that from the hydraulic remote control (52), it is the pressure from the manipulator (58) that acts on the directional control valve (55). Conversely, when the inclination of the bucket causes the cam (35) to move in such a way that the pressure delivered by the hydraulic remote control (52) is higher than the pressure from the manipulator (58), this correction pressure from the hydraulic remote control (52) acts on the directional control valve (55). In practice, the law governing the control of the hydraulic remote control is illustrated in FIG. 5, in which it can be seen that the curve (65) in dotted line illustrating the value of the pressure as a function of the travel of the cam lies above the curve in solid line (66) corresponding to the pressure from the hydraulic manipulator (58) as a function of the travel of the latter.

Figure 2:
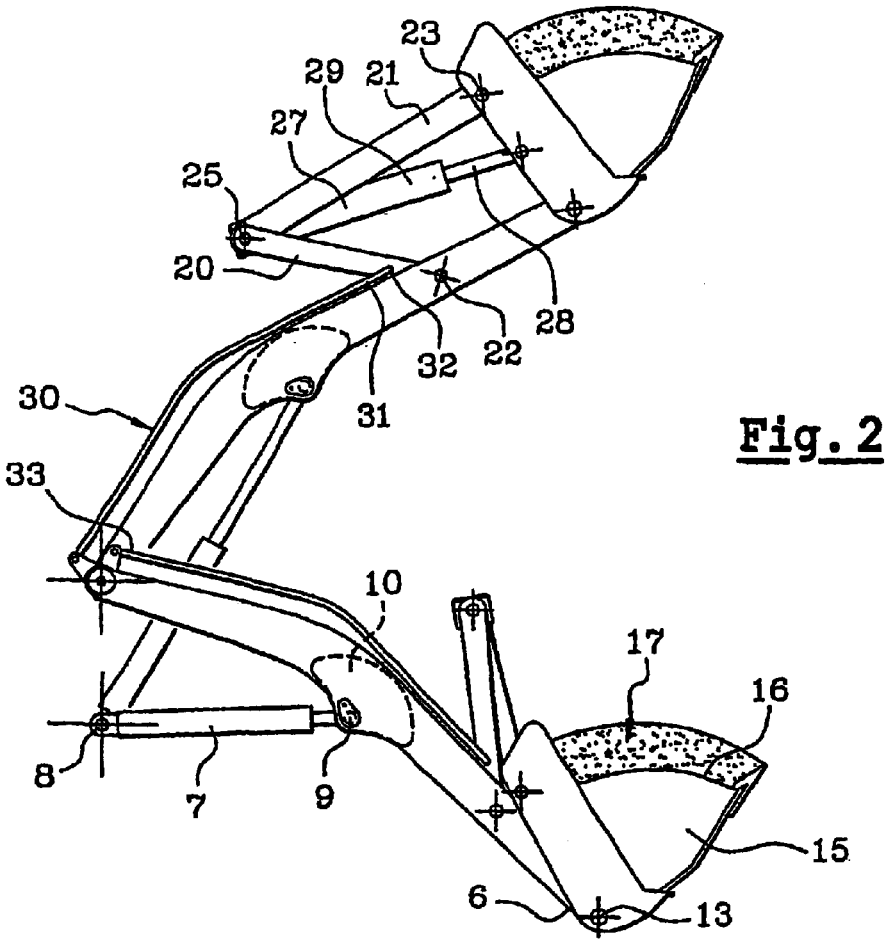
FIG. 2 is a side view of the work equipment of the loader of FIG. 1, shown in two different arm positions.

In practice, during the loading operation, the driver places his bucket (15) in such a way that it has its opening (16) facing forward, so as to fill the bucket. He then acts on the manipulator (58) to pivot the bucket (15) backward. The pressure then coming from the manipulator (58) is higher than the pressure from the hydraulic remote control (52), which is zero because the hydraulic remote control is not activated. Thereafter, when the main arms (3) are raised, as illustrated in FIG. 2, the connecting bar (30) moves, therefore causing the cam (35) to move. Above and beyond a certain height, the pressure from the hydraulic remote control T2 therefore exceeds the pressure delivered by the manipulator (58) and it is this pressure which, via the circuit selector (54), acts on the directional control valve (55) to cause the bucket actuator (27) to be supplied with fluid in a direction for orientating this bucket forward, as illustrated in the upper part of FIG. 2.

In other words, the system automatically compensates for the inclination of the bucket to prevent the latter from tipping backward, if it remained in the initial inclination, corresponding to that of the bottom part of FIG. 2.

It is apparent from the foregoing that the machine according to the invention has the essential advantage of allowing automatic correction of the inclination of the bucket, which cannot be felt at the control manipulator. This automatic correction increases driver safety, because the risk of materials dropping out backward is eliminated.

What is claimed is:

1. A construction engineering machine of the loader type, comprising a chassis and work equipment which includes:

two parallel arms articulated with respect to the chassis;

a bucket articulated with respect to the arms;

a set of link rods forming, with a portion of the bucket and of the arms, a deformable parallelogram;

a bucket actuator designed to be controlled in order to cause deformation of the deformable parallelogram so as to orientate the bucket with respect to the arms;

a hydraulic control circuit allowing the bucket actuator to be supplied via a directional control valve controlled by a hydraulic manipulator delivering a control pressure;

a cam moved by a connecting bar connected by one end to the deformable parallelogram so that position of the cam is dependent on orientation of the bucket with respect to the chassis;

a hydraulic device allowing the generation of an additional control pressure according to the position of the cam; and a circuit selector able to transmit to the directional control valve the higher of the control pressure delivered by the manipulator and the additional control pressure, so that the orientation of the bucket is kept in a position that prevents its unwanted tipping backward, regardless of commands exerted on the manipulator by a driver.

2. The machine as claimed in claim 1, wherein the circuit selector is arranged on a portion of the hydraulic control circuit concerned with tipping-out of the bucket.

* * * * *